US005190401A

United States Patent [19]

Wilson

[11] Patent Number: 5,190,401

[45] Date of Patent: Mar. 2, 1993

[54] WHEELED CONCRETE SCREED

[76] Inventor: Louis A. Wilson, R.R. 4, North Vernon, Ind. 47265

[21] Appl. No.: 690,117

[22] Filed: Apr. 23, 1991

[51] Int. Cl.[5] ..... E01C 19/22

[52] U.S. Cl. ..... 404/118; 404/96

[58] Field of Search ..... 404/118-120, 404/96-97, 112

[56] References Cited

U.S. PATENT DOCUMENTS

| | | | |
|---|---|---|---|
| 791,726 | 6/1905 | Schutte | 404/118 X |
| 2,635,888 | 4/1953 | Bailiff | 404/118 X |
| 3,067,656 | 12/1962 | Gustafsson . | |
| 4,359,296 | 11/1982 | Cronkhite . | |
| 4,449,845 | 5/1984 | Carrillo . | |
| 4,591,291 | 5/1986 | Owens . | |
| 4,629,359 | 12/1986 | Sengupta | 404/112 |
| 4,838,730 | 6/1989 | Owens | 404/97 X |
| 4,848,961 | 7/1989 | Rouilard | 404/97 |
| 5,062,738 | 11/1991 | Owens | 404/118 X |
| 5,096,330 | 3/1991 | Artzberger . | |

OTHER PUBLICATIONS 2-sided brochure captioned "Owens Concrete Screed".

3-holed folded pamphlet captioned "Razorback Floater® Floats on plastic concrete, No forms needed" of Allen Engineering Corporation, Paragould, Ark.

*Primary Examiner*—Carl D. Friedman

*Assistant Examiner*—Nancy P. Connolly

*Attorney, Agent, or Firm*—Woodward, Emhardt, Naughton, Moriarty & McNett

[57] ABSTRACT

A wheeled concrete screed, comprising a strike board and blade assembly, a pair of corresponding main handle members pivotally mounted to the strike board and blade assembly, a pair of corresponding wheel assemblies affixed to and extending downwardly from the main handle members, and means to adjust the pitch of the strike board and blade assembly independent of changes in elevation of the strike board and blade assembly.

5 Claims, 5 Drawing Sheets

WHEELED CONCRETE SCREED

BACKGROUND OF THE INVENTION

The present invention relates generally to concrete screeds, which are strike boards and/or finish blades usually used to level up or strike off and/or finish concrete pavement slabs. More particularly, the present invention is concerned with a novel wheeled concrete screed.

When form boards can not be used to support concrete screed strike boards and/or finish blades at the proper elevation and pitch, operators of prior art screeds have manually held screed strike boards and/or finishing blades at desired elevations and blade pitches, while walking backwards, using only hand-held grips, or hand-held grips in conjunction with an operator-worn, counter-balancing harness, such as the concrete screed harness shown in U.S. Pat. No. 4,591,291.

SUMMARY OF THE INVENTION

The present invention provides a novel wheeled concrete screed that provides wheel-assisted elevation and finishing blade pitch control, rendering the wheeled concrete screed of the present invention easier for operators to handle and to control than are the wheel-less concrete screeds of the prior art.

One embodiment of the invention is a wheeled concrete screed comprising a concrete screed strike board, a pair of corresponding main handle members mounted to the strike board, and a pair of corresponding wheel assemblies affixed to and extending downwardly from the main handle members.

Another embodiment of the invention is a wheeled concrete screed, comprising a strike board and blade assembly, a pair of corresponding main handle members pivotally mounted to the strike board and blade assembly, and means to adjust the pitch of the strike board and blade assembly independent of changes in elevation of the strike board and blade assembly.

Yet another embodiment of the invention is a wheeled concrete screed, comprising a strike board and blade assembly, a pair of corresponding main handle members pivotally mounted to the strike board and blade assembly, a pair of corresponding wheel assemblies affixed to and extending downwardly from the main handle members, and means to adjust the pitch of the strike board and blade assembly independent of changes in elevation of the strike board and blade assembly.

It is an object of the present invention to provide a concrete screed that is easier for operators to handle and to control than are the screeds of the prior art.

Related objects and advantages of the present invention will be apparent from the following descriptions.

DESCRIPTION OF THE PREFERRED EMBODIMENT

Figure 1:
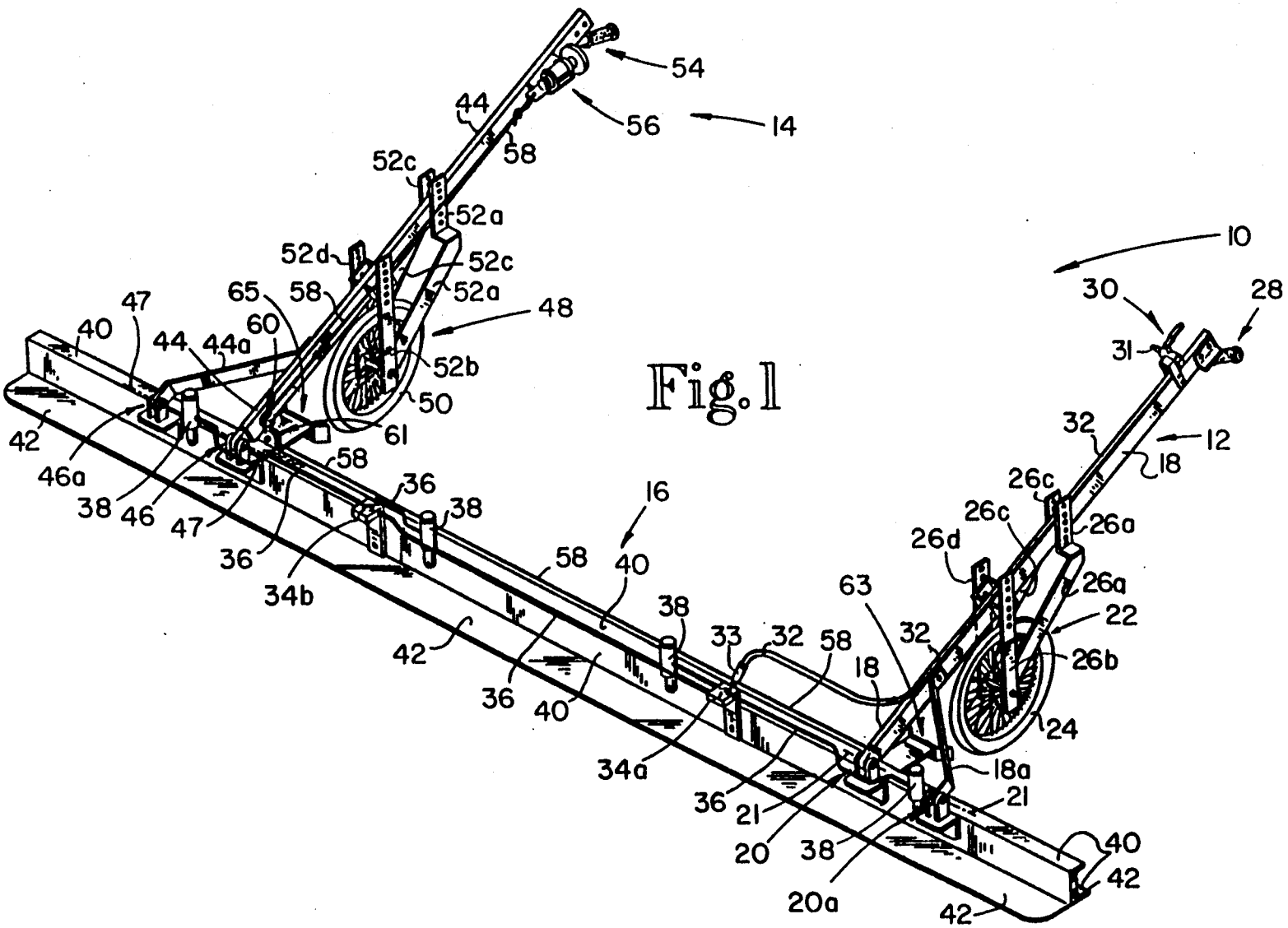
FIG. 1 is perspective view of one embodiment of the wheeled concrete screed of the present invention.
Figure 2:
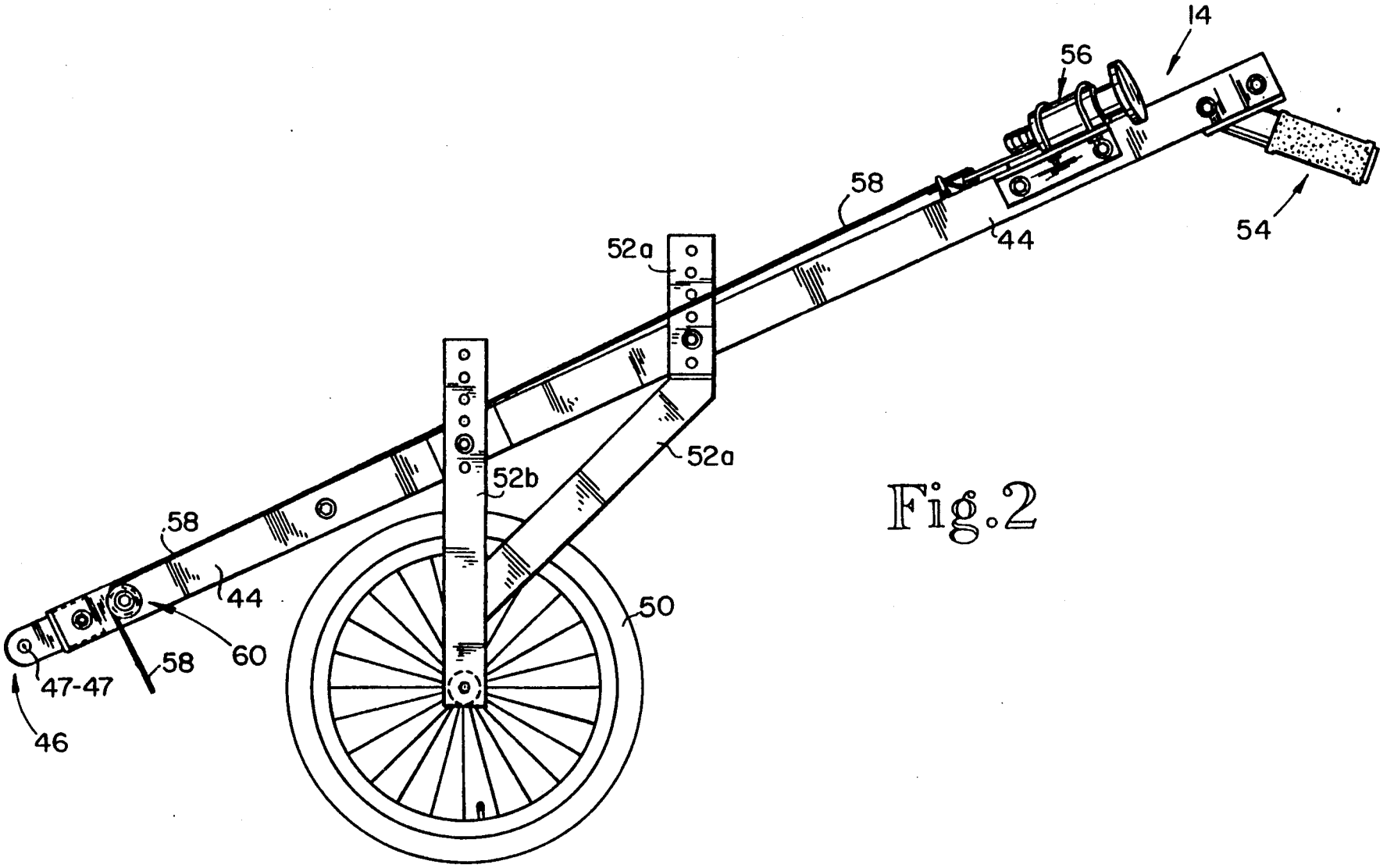
FIG. 2 is an elevational view of the right side wheel and handle assembly 14 of the wheeled concrete screed of FIG. 1.
Figure 3:
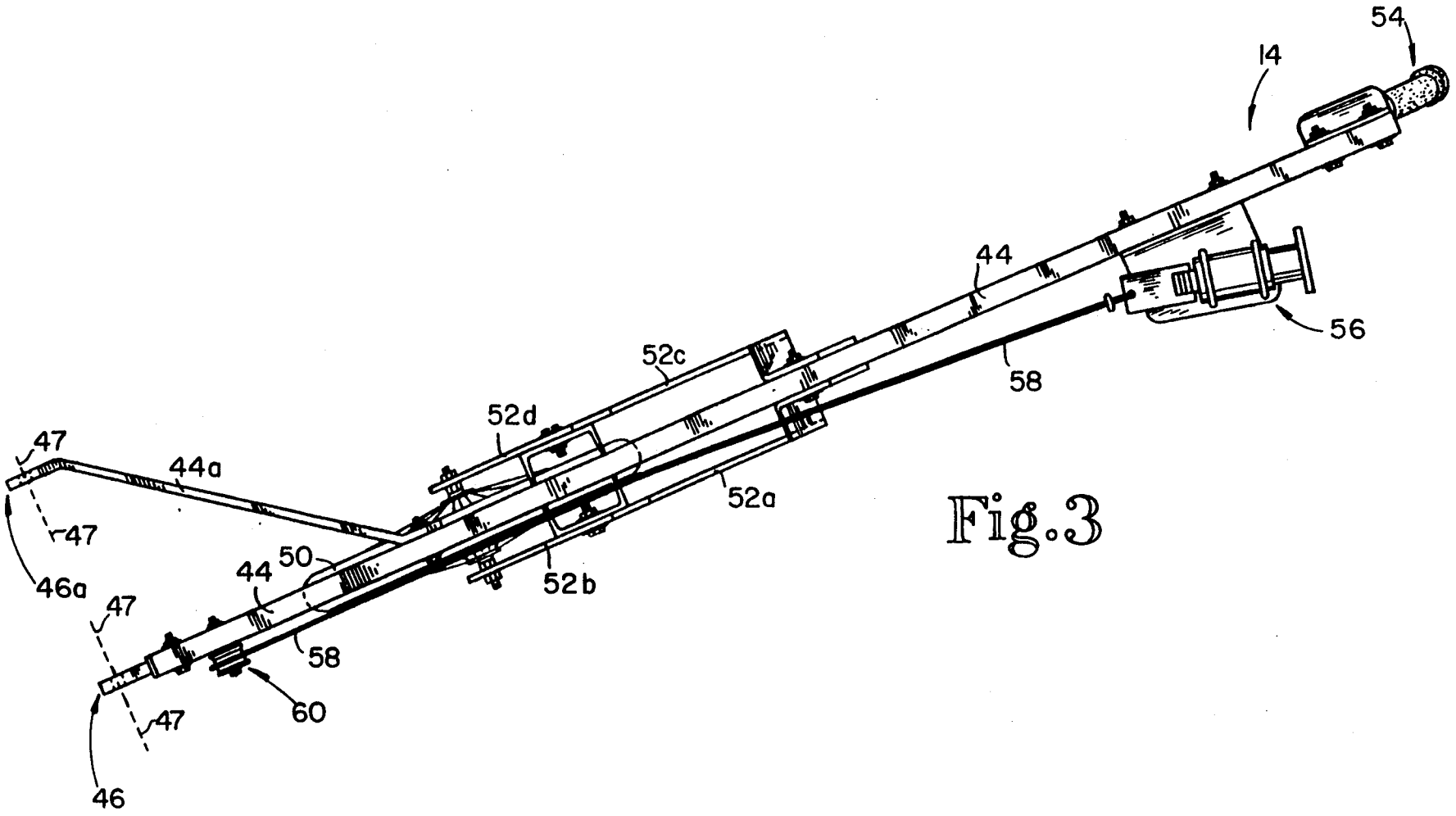
FIG. 3 is a top plan view of the wheel and handle assembly of FIG. 2.
Figure 5:
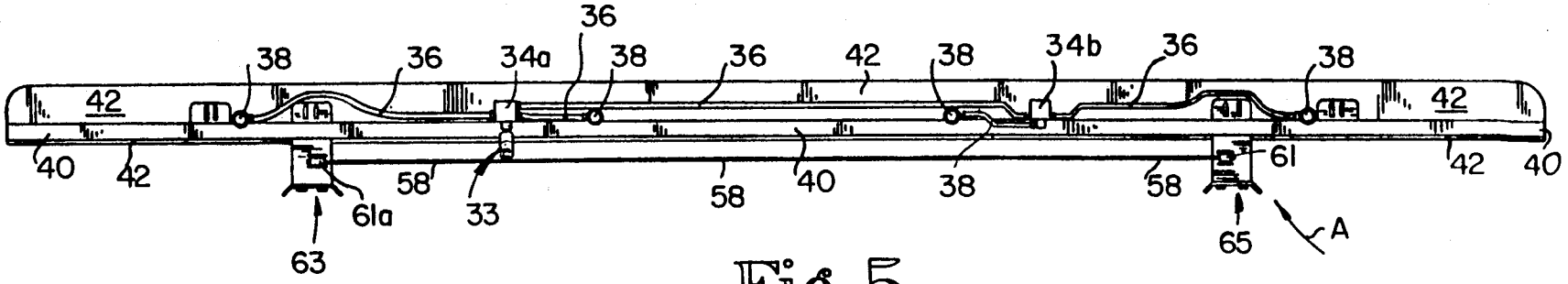
FIG. 5 is a top plan view of the strike board and blade assembly of FIG. 4.
Figure 4:
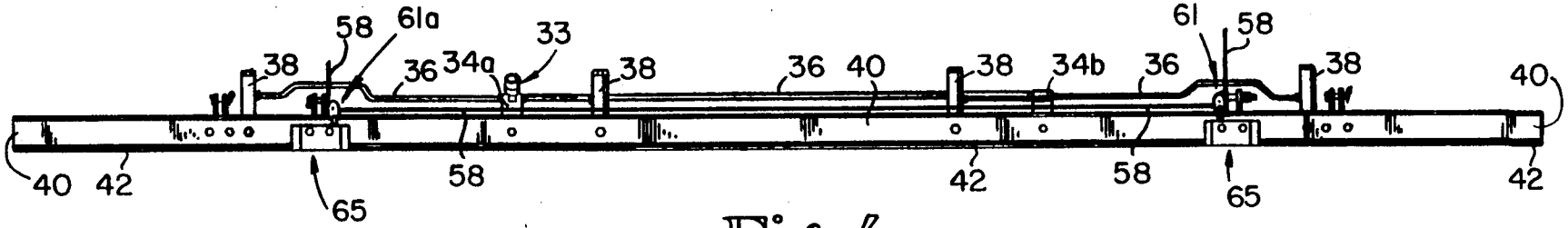
FIG. 4 is a rear elevational view of strike board and blade assembly 16 of the wheeled concrete screed of FIG. 1.
Figure 6:
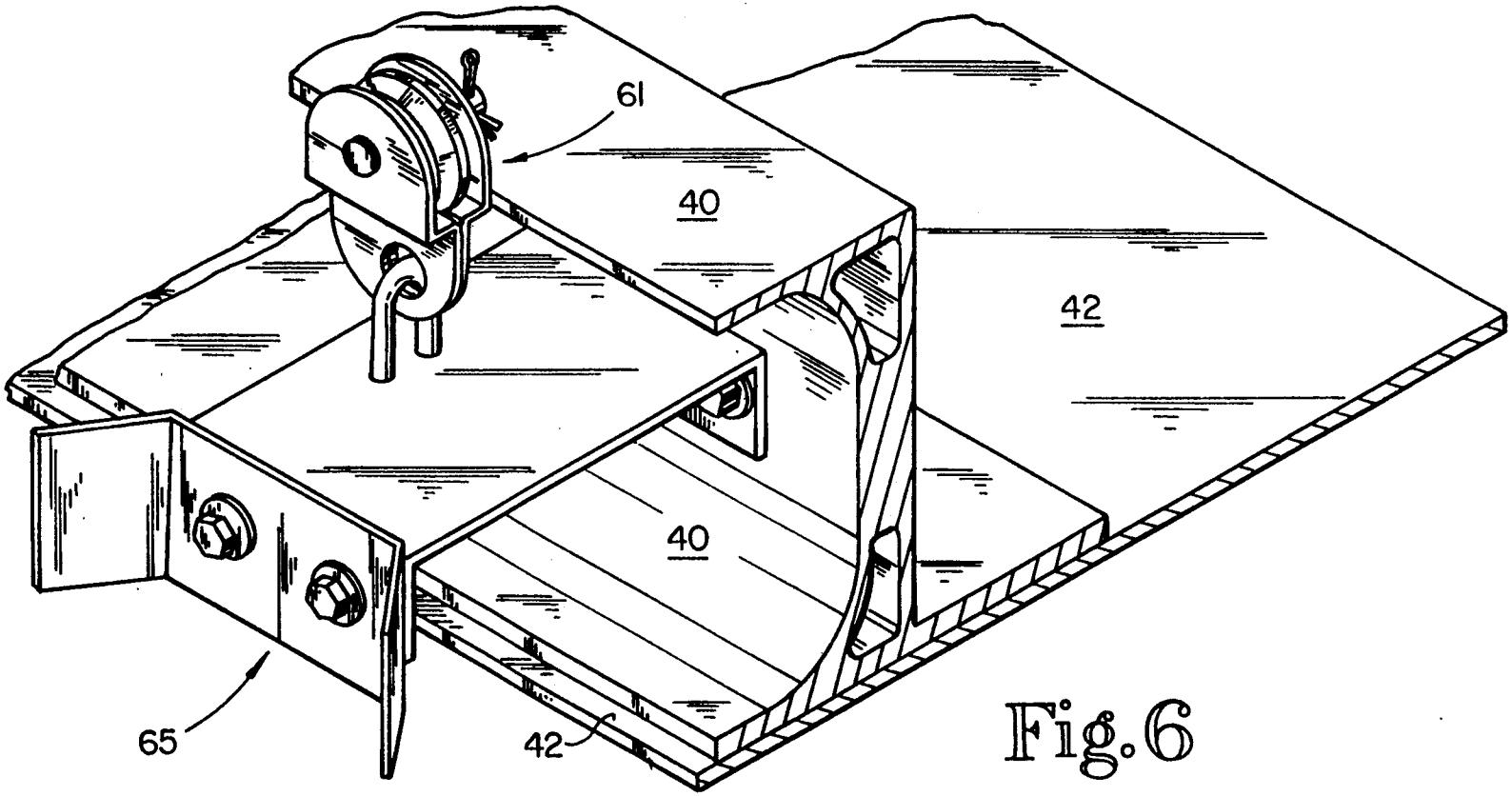
FIG. 6 is an enlarged, partially segmented, perspective view of the strike board and blade assembly 16 of FIG. 4 viewed in the direction of arrow A in FIG. 5.

For the purposes of promoting an understanding of the principles of the invention, reference will now be made to the embodiment illustrated in the drawings, and specific language will be used to describe the same. It will nevertheless be understood that no limitation of the scope of the invention is thereby intended, such alterations and further modifications in the illustrated device, and such further applications of the principles of the invention illustrated therein being contemplated as would normally occur to one skilled in the art to which the invention relates.

Referring now to the drawings, there is illustrated in FIGS. 1–6 a preferred embodiment of the wheeled concrete screed 10 of the present invention. Wheeled concrete screed 10 includes three sub-assemblies: 12, 14, and 16. Sub-assembly 12 is the left side wheel and handle assembly, sub-assembly 14 is the right side wheel and handle assembly, and sub-assembly 16 is the strike board and blade assembly.

Sub-assembly 12 includes a first main handle member 18 that is pivotally mounted at one end, at location 20, to sub-assembly 16, so that main handle member 18 pivots at its point of attachment to sub-assembly 16, location 20, about an axis represented by line 21—21. Angled support member **18*a* is also pivotally mounted at one end, location 20*a*, to sub-assembly 16 so that angled support member 18*a* also pivots about an axis represented by line 21—21. Angled support member 18*a* is affixed at its other end to main handle member 18. Angled support member 18*a* thereby provides horizontal rigidity to main handle member 18, vis-a-vis sub-assembly 16, yet does not restrict the pivotal movement of main handle member 18 in the vertical plane about the axis represented by line 21—21**.

Adjustably affixed and extending downwardly from main handle member 18 is first wheel assembly 22, including first wheel 24 and first wheel support framing **26*a–d*. First wheel support framing 26*a–d* of the embodiment illustrated in FIG. 1 is adjustably bolted to main handle member 18 so that the disposition of first wheel 24 below main handle member 18 can be adjusted up and down as well as fore and aft with respect to main handle member 18**.

Affixed at the end of main handle member 18 opposite the end pivotally attached to sub-assembly 16 is a first operator hand grip 28. Adjacent first operator hand grip 218 is a conventional air valve 30 provided with a quick connect air fitting 31. The embodiment of the wheeled concrete screed 10 of the present invention illustrated in FIG. 1 is provided with conventional air driven means to vibrate sub-assembly 16. These conventional means illustrated in FIG. 1 include air valve 30, which feeds compressed air through air hose 32 to a quick connect air fitting 33 that is connected to an air connection block **34*a*. Air block 34*a* communicates compressed air through a series of air hoses 36, and a second air connection block 34*b*, which collectively feed compressed air into conventional piston air vibrators 38. Conventional piston air vibrators 38 are affixed to sub-assembly 16** in a manner that causes air vibrators 38 to impart a vibration to sub-assembly 16 when air valve 30 is opened to a source of compressed air.

Sub-assembly 16 includes, in addition to the vibration imparting elements discussed above, a conventional strike board 40 for leveling up or striking off concrete pavement slabs. Affixed to the bottom of strike board 40 is finishing blade 42. The pitch of finishing blade 40 over wet concrete will determine the finish grade imparted to the concrete as wheeled concrete screed 10 traverses a concrete slab, about which more will be said below.

Sub-assembly 14 includes a second main handle member 44 that is pivotally mounted at one end, at location 46, to sub-assembly 16, so that main handle member 44 pivots at its point of attachment to sub-assembly 16, location 46, about an axis represented by line 47—47. Angled support member 44*a* is also pivotally mounted at one end, location 46*a*, to sub-assembly 16 so that angled support member 44*a* also pivots about an axis represented by line 47—47. Angled support member 44*a* is affixed at its other end to main handle member 44. Angled support member 44*a* thereby provides horizontal rigidity to main handle member 44, vis-a-vis sub-assembly 16, yet does not restrict the pivotal movement of second main handle member 44 in the vertical plane about the axis represented by line 47—47.

Adjustably affixed and extending downwardly from second main handle member 44 is second wheel assembly 48, including second wheel 50 and second wheel support framing 52*a–d*. Second wheel support framing 52*a–d* of the embodiment illustrated in FIG. 1 is also adjustably bolted to main handle member 44 so that the disposition of second wheel 50 below main handle member 44 can also be adjusted up and down as well as fore and aft with respect to main handle member 44.

Affixed at the end of second main handle member 44 opposite the end pivotally attached to sub-assembly 16 is a second operator hand grip 54. Adjacent second operator hand grip 28 is a sub-assembly 16 tube and plunger pitch control adjustor 56. Pitch control adjustor 56 controls pitch wire 58, which is affixed to pitch control adjustor 56 and runs downwardly along second main handle member 44 to a first pulley 60 affixed to second main handle member 44, which turns pitch wire 58 downwardly toward a nearby second pulley 61 affixed to sub-assembly 16. Second pulley 61 turns pitch wire 58 to run along and parallel with sub-assembly 16 toward first main handle member 18. In close proximity to first main handle member 18, pitch wire 58 is turned upwardly to run along first main handle member 18 by a set of pulleys (not shown in FIG. 1) identical to first and second pulleys 60 and 61, one such pulley 61*a* (FIGS. 4 and 5) being affixed to sub-assembly 16 in proximity to first main handle member 18 as is second pulley 61, and the other being affixed to first main handle member 18 as first pulley 60 is affixed to second main handle member 44.

In the preferred embodiment illustrated, pitch wire 38 extends upwardly along first main handle member 18 and is affixed to first wheel support framing 26*d*. So constructed, moving the tube and plunger pitch control adjuster 56 in and out will lower and raise, respectively, the elevations of second pulley 61, and its counterpart pulley 61*a* (FIGS. 4 and 5) affixed to sub-assembly 16 adjacent first main handle member 18, vis-a-vis first and second main handle members 18 and 44, which will have the effect of adjusting the pitch of sub-assembly 16, and finishing blade 42 vis-a-vis first and second main handle members 18 and 44 as sub-assembly 16 rotates about axes represented by lines 21—21 and 47—47.

Attached to the rear of sub-assembly 16 and disposed directly between sub-assembly 16 and each of first and second wheels 24 and 50 are first and second drags 63 and 65, which effectively fill in the wheel ruts formed in wet cement by first and second wheels 24 and 50 as the wheeled concrete screed 10 is rolled rearwardly over wet concrete. The weight of the wheeled concrete screed 10 will be borne by the first and second wheels 24 and 50. The elevation of sub-assembly 16 is then easily adjusted by the operators using the leveraging capability of the first and second main members 18 and 44 about the axles of wheels 24 and 50. The pitch of blade 42 of sub-assembly 16, which controls the finish applied to the wet concrete as the wheeled concrete screed 10 traverses the concrete, is easily adjusted with pitch control adjustor 56. The wheeled concrete screed 10 of the present invention thereby provides mechanical advantages for full elevation and finishing blade pitch control not found in the wheel-less screeds of the prior art. The first and second wheels 24 and 50 provide the basis for such advantages, which render the wheeled concrete screed 10 of the present invention far easier for operators to move about and to control in operation than any known wheel-less screeds of the prior art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A wheeled concrete screed, comprising:

a strike board and blade assembly;

a pair of corresponding main handle members pivotally mounted to said strike board and blade assembly;

a pair of corresponding wheel assemblies affixed to and extending downwardly from said main handle members;

means to adjust the pitch of said strike board and blade assembly independent of changes in elevation of said strike board and blade assembly; and means interposed between said strike board and blade assembly and each of said wheel assemblies that fill in wheel ruts created by said wheel assemblies as said wheel assemblies traverse wet concrete.

2. The wheeled concrete screed of claim 1 wherein said pair of corresponding wheel assemblies are adjustably affixed to said main handle members so that the disposition of said wheel assemblies below said main handle members can be adjusted up and down as well as fore and aft with respect to said main handle members.

3. The wheeled concrete screed of claim 1 wherein said means to adjust the pitch of said strike board and blade assembly includes a pitch control adjustor attached to a first one of said main handle members, a pitch control wire attached to said adjustor and extending along said first main handle member toward said strike board and blade assembly where said pitch control wire is turned by a first pair of pulleys, one affixed to said first main handle member and one affixed to said strike board and blade assembly, to run along said strike board and blade assembly towards a second one of said main handle members where said pitch control wire is turned by a second pair of pulleys, one affixed to said strike board and blade assembly and one affixed to said second main handle member, to run along said second main handle member to the corresponding wheel assembly affixed to said second handle member where said pitch wire is affixed.

4. A wheeled concrete screed, comprising:

a concrete screed strike board;

a pair of corresponding main handle members mounted to said strike board;

a pair of corresponding wheel assemblies affixed to and extending downwardly from said main handle members and adjustably affixed to said main handle members so that the disposition of said wheel assemblies below said main handle members can be adjusted up and down as well as fore and aft with respect to said main handle members.

5. A wheeled concrete screed, comprising:

a strike board and blade assembly;

a pair of corresponding main handle members pivotally mounted to said strike board and blade assembly;

means to adjust the pitch of said strike board and blade assembly independent of changes in elevation of said strike board and blade assembly, including a pitch control adjustor attached to a first one of said main handle members, a pitch control wire attached to said adjustor and extending along said first main handle member toward said strike board and blade assembly where said pitch control wire is turned by a first pair of pulleys, one affixed to said first main handle member and one affixed to said strike board and blade assembly, to run along said strike board and blade assembly towards a second one of said main handle members where said pitch control wire is turned by a second pair of pulleys, one affixed to said strike board and blade assembly and one affixed to said second main handle member, to run along said second main handle member to the corresponding wheel assembly affixed to said second handle member where said pitch wire is affixed.

* * * * *

UNITED STATES PATENT AND TRADEMARK OFFICE

CERTIFICATE OF CORRECTION

PATENT NO. : 5,190,401

DATED : March 2, 1993

INVENTOR(S) : Louis A. Wilson

It is certified that error appears in the above-indentified patent and that said Letters Patent is hereby corrected as shown below:

On the title page, after Item [56]: in the Attorney, Agent, or Firm Section, change "Woodward" to —Woodard—.

Column 2, line 55, change "218" to —28—.

Signed and Sealed this

Twenty-third Day of November, 1993

*Attest:*

Bruce Lehman

BRUCE LEHMAN

*Attesting Officer*

*Commissioner of Patents and Trademarks*